US007435205B2

(12) United States Patent
Reyes et al.

(10) Patent No.: US 7,435,205 B2
(45) Date of Patent: Oct. 14, 2008

(54) EXERCISE MACHINE INCLUDING WEIGHT MEASUREMENT SYSTEM

(75) Inventors: Javier J. Reyes, Fullerton, CA (US); Kevin P. Corbalis, Tustin, CA (US); Victor Torres Cornejo, Tustin, CA (US); Felipe J. Marin, Santa Ana, CA (US); Gregory A. Wallace, Mission Viejo, CA (US)

(73) Assignee: Unisen, Inc., Irvine, CA (US)

( * ) Notice: Subject to any disclaimer, the term of this patent is extended or adjusted under 35 U.S.C. 154(b) by 0 days.

(21) Appl. No.: 11/479,448

(22) Filed: Jun. 30, 2006

(65) Prior Publication Data

US 2007/0004563 A1 Jan. 4, 2007

Related U.S. Application Data

(63) Continuation of application No. 10/313,097, filed on Dec. 5, 2002, now Pat. No. 7,070,542.

(60) Provisional application No. 60/399,336, filed on Jul. 26, 2002.

(51) Int. Cl.
*A63B 22/02* (2006.01)

(52) U.S. Cl. ..... 482/54; 482/51

(58) Field of Classification Search ..... 482/1–9, 482/51, 54, 900–902; 119/700; 177/245
See application file for complete search history.

(56) References Cited

U.S. PATENT DOCUMENTS 4,332,217 A 6/1982 Davis
4,775,018 A * 10/1988 Kroll et al. ..... 177/134
4,828,257 A * 5/1989 Dyer et al. ..... 482/5
5,273,502 A 12/1993 Kelsey et al.
5,435,315 A 7/1995 McPhee et al.
5,830,162 A * 11/1998 Giovannetti ..... 601/23
5,879,270 A 3/1999 Huish et al.
5,987,982 A * 11/1999 Wenman et al. ..... 73/379.08
6,354,996 B1 * 3/2002 Drinan et al. ..... 600/300
6,527,678 B1 * 3/2003 Wang et al. ..... 482/51
6,626,803 B1 9/2003 Oglesby et al.
6,659,916 B1 * 12/2003 Shea ..... 482/57
6,719,667 B2 4/2004 Wong et al.
6,749,537 B1 6/2004 Hickman
6,783,482 B2 8/2004 Oglesby et al.
2002/0055419 A1 * 5/2002 Hinnebusch ..... 482/8

* cited by examiner

*Primary Examiner*—Glenn Richman
(74) *Attorney, Agent, or Firm*—Knobbe, Martens, Olson & Bear, LLP

(57) ABSTRACT

An exercise machine including a weight measurement system which provides a signal representative of a user's weight. An embodiment of the weight measurement system includes at least one load cell outputting a signal used by a microprocessor to determine an accurate value of the users weight. An embodiment of the weight measurement system includes a plurality of load cells using a Wheatstone bridge configuration to output a signal representative of a user's weight regardless of whether the weight is evenly distributed across each load cell. A calibration process calibrates the load cells for each exercise machine.

16 Claims, 9 Drawing Sheets

EXERCISE MACHINE INCLUDING WEIGHT MEASUREMENT SYSTEM

REFERENCE TO RELATED APPLICATIONS

The present application is a continuation of U.S. patent application Ser. No. 10/313,097, filed Dec. 5, 2002, now U.S. Pat. No. 7,070,542, entitled "Exercise Machine Including Weight Measurement System," which claims priority benefit under 35 U.S.C. §119(e) from U.S. Provisional Application No. 60/399,336, filed Jul. 26, 2002, entitled "Cooling System for Exercise Machine." The present application incorporates the foregoing disclosures herein by reference.

FIELD OF THE INVENTION

Aspects of the present invention relate to the field of exercise machines. More specifically, the invention relates to exercise machines including weight acquisition mechanisms.

BACKGROUND OF THE INVENTION

Many commercially available residential and industrial exercise machines include computing systems which request entry of a user's weight. Often, the computing systems use the entered weight to control a resistance, speed, or inclination of the exercise machine. Moreover, the computing systems use the entered weight to configure exercise routines, recommend optimal or other exercise parameters, control user feedback, determine physiological parameters, or the like.

Thus, many exercise machines rely on a user-entered value of a user's weight to calculate exercise parameters, determine recommendations, configure routines or fitness programs, or the like. Moreover, some exercise machines rely on the user-entered value of the user's weight to configure parameters of the exercise machine. However, there are a variety of reasons why users may not enter accurate information about their weight. For example, users may not actually know their current weight, or misunderstand the purpose for entering their weight. For example, a user may enter a greater value for his or her weight because he or she believes the exercise machine will provide a more difficult or easier workout. Still other users may enter inaccurate information because they are self-conscious about their weight.

For whatever reason, use of inaccurate weight values can result in the exercise machine potentially recommending exercise parameters or configuring itself in manner not optimally suited for the user. Misconfiguration can result in diminished returns for the exercises performed, which can result in eventual discontinued use of the exercise machine.

SUMMARY OF THE INVENTION

Based on at least the foregoing, aspects of the present invention include an exercise machine having a straightforward, accurate, discreet weight measurement system. According to an embodiment, the weight measurement system communicates with a microprocessor to convey a signal representative of a value of a user's weight. The microprocessor then employs the value to, for example, recommend exercise parameters, provide user feedback, configure the exercise machine, or the like. According to an embodiment, the weight measurement system acquires the value during static operation of the exercise machine, such as before and after exercises are performed.

The weight measurement system preferably includes one or more load cells configured to output a signal indicative of a user's weight. The weight measurement system also includes a calibration process providing for substantially error free load cell replacement as well as accurate determination of the user's weight. In an embodiment employing two load cells, the weight measurement system outputs a signal representative of the user's weight regardless of whether the weight is equally distributed between the two load cells. For example, the two load cells may each be arranged in a Wheatstone Bridge configuration, which when wired in parallel, outputs a signal representative of the user's weight even during unequal distribution.

According to a footpad detection embodiment of the weight measurement system, the exercise machine includes non-slip platforms or footpads designed to receive the user's weight in a comfortable and safe manner. According to a deck detection embodiment of the weight measurement system, the exercise machine includes load cells attached to an exercise assembly in a manner supporting at least a portion of the weight of the assembly as well as the weight of the user.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements. In addition, the first digit of each reference number indicates the figure in which the element first appears.

DETAILED DESCRIPTION OF THE PREFERRED EMBODIMENTS

Aspects of the invention include an exercise machine having a weight measurement system which outputs a signal indicative of a value of a user's current weight. A microprocessor energizes a weight measurement system and a user applies their weight thereto. The weight measurement system outputs a signal to the microprocessor, which uses calibration values to determine a value of the user's weight within an accepted error. The microprocessor then uses the determined value, as opposed to a user-entered weight value prone to be inaccurate, for computation and use in various programmatic and configuration functions of the exercise machine. In an embodiment, the microprocessor executes a calibration process to measure a zero weight output and a test weight output of the weight measurement system, and determine the calibration values.

In a footpad detection embodiment, a pair of non-slip substantially oval platforms or footpads mechanically connect to a pair of load cells so that when a user applies weight to the oval platforms by standing on the same, the load cells receive the weight. In a deck detection embodiment, a plurality of feet supporting the exercise machine mechanically connect to a pair of load cells so that when a user applies weight to the exercise machine by standing on, for example, an endless belt or a portion of the frame, the load cells receive the weight. The load cells are preferably electrically connected in parallel and each preferably form a full Wheatstone Bridge configuration. Such connectivity provides an output of an signal indicative of the user's current weight, even during unequal distribution of the same across the load cells.

To facilitate a complete understanding of the invention, the remainder of the detailed description describes the invention with reference to the drawings, wherein like reference numbers are referenced with like numerals throughout.

Figure 1:
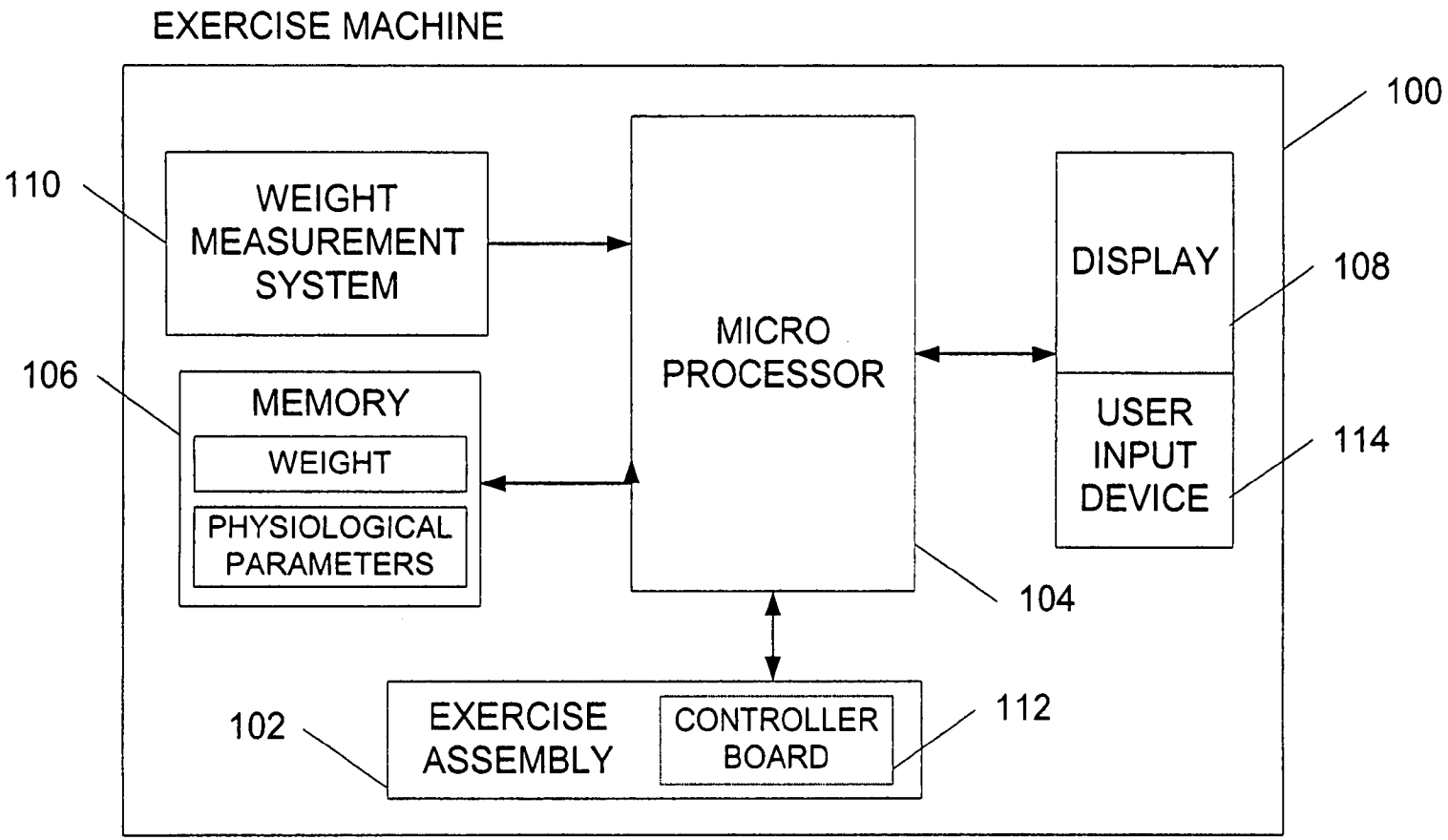
FIG. 1 illustrates a block diagram of an exercise machine including a weight measurement system, according to aspects of an embodiment of the invention.

FIG. 1 illustrates a block diagram of an exercise machine 100 including an exercise assembly 102, a microprocessor 104 accessing a memory 106, a display 108, and a weight measurement system 110, according to aspects of an embodiment of the invention. According to an embodiment, the exercise machine 100 comprises a microprocessor-controlled exercise device affording a user an aerobic workout, such as, for example, walking, jogging, running, biking, climbing, skiing, lifting, or the like, over simulated terrain conditions at various speeds and incline levels. In a preferred embodiment, the exercise machine 100 comprises an electrically-powered treadmill.

The exercise assembly 102 comprises mechanical mechanisms that interact with the user to provide the user with exercise. For example, in the embodiment of a treadmill, the exercise assembly 102 can include an endless belt extended over a support surface and rotated by a motor controlled by a controller board 112 in a fashion which allows a user standing thereon to walk, jog, run or the like. However, a skill artisan will recognize from the disclosure herein that other exercise assemblies may not include the controller board 112 and/or may provide exercise to the user without electronic drive components, such as, for example, a stationary bike, a climbing machine, a striding elliptical machine, or the like.

In one embodiment, the exercise assembly 102 provides output signals to the microprocessor 104 indicative of parameters of the assembly 102. For example, the output signals may include an indication of exercise speed, resistance, inclination, or the like. Moreover, the output signal may include physiological parameters such as heart rate or the like. According to one embodiment, the microprocessor 104 comprises a microcontroller such as those commercially available from Atmel Corporation under the name Atmel MegaAVL 103 microcontroller.

FIG. 1 also shows the microprocessor 104 accessing the memory 106. As will be understood by a skilled artisan from the disclosure herein, the memory 106 may comprise RAM, ROM, on-chip or off-chip memory, cache memory, or other more static memory such as magnetic or optical disk memory. The memory 106 stores a value of the user's weight and one or more physiological parameters, such as, for example, body mass index (BMI), current, total or projected caloric burn or burn rates, percent body fat, fitness numbers or testing, or the like. Additionally, the memory 106 may store other data used or needed by the microprocessor 104 to provide some or all of the audio/visual feedback disclosed below, including but not limited to, exercise or training routines or programs, exercise parameters, configuration parameters, current status information of the exercise assembly 102, or the like.

Users interface with and control the exercise machine 100 via preprogrammed commands, and/or the display 108, which includes a user input device 114 such as a keypad assembly. For example, the user may control the exercise machine 100 by direct input, such as speed control, incline control, change of preprogrammed exercise regimes or routine levels, or the like. In addition, the microprocessor 104 may control the exercise machine 100 via preprogrammed exercise routines generally comprising a series of speed and/or incline commands used to simulate various terrain conditions or exercise environments.

In one embodiment, the display 108 provides the user audio/visual feedback during program selection and operation of the exercise machine 100, including, for example, speed, incline, elapse workout time, distance traveled, distance or time remaining, calories burned, heart rate, other physiological parameters, graphical display indicating terrain profiles or workout intensity, or the like. In one embodiment, the display 108 and keypad assembly comprise a vacuum fluorescent display, an LED matrix display, and a plurality of seven segment numeric LED banks.

Although the exercise machine 100, the display 108, and the keypad assembly are disclosed with reference to their preferred embodiments, the disclosure is not intended to be limited thereby. Rather, a skilled artisan will recognize from the disclosure herein a wide number of alternatives for the exercise machine 100, the display 108, and the keypad assembly. For example, the exercise machine 100 may comprise virtually any apparatus configurable to provide exercise to a user, while the display 108 and keypad assembly may comprise a wide number of commercially available audio/visual feedback devices, user input devices, or the like, including commercially available computing devices such as laptops, personal digital assistants, digital tablets, or the like.

FIG. 1 also shows the weight measurement system 110. According to one embodiment, the weight measurement system 110 acquires an indication of a current value of a user's weight. For example, the weight measurement system 110 acquires a displacement of a measurement assembly, such as, for example, a strain gauge, in the form of a voltage and/or current change, and outputs that change or a representation thereof to the microprocessor 104. According to an embodiment, the weight measurement system 110 outputs a digital signal representative of a change of electronic characteristics of one or more strain gauges.

Once the microprocessor 104 receives the output from the weight measurement system 110, it calculates a value of the user's weight and, for example, stores the value in the memory 106. Moreover, the microprocessor 104 can also store the physiological parameters discussed in the foregoing, some of which are also calculated from the value of the user's weight.

Figure 2:
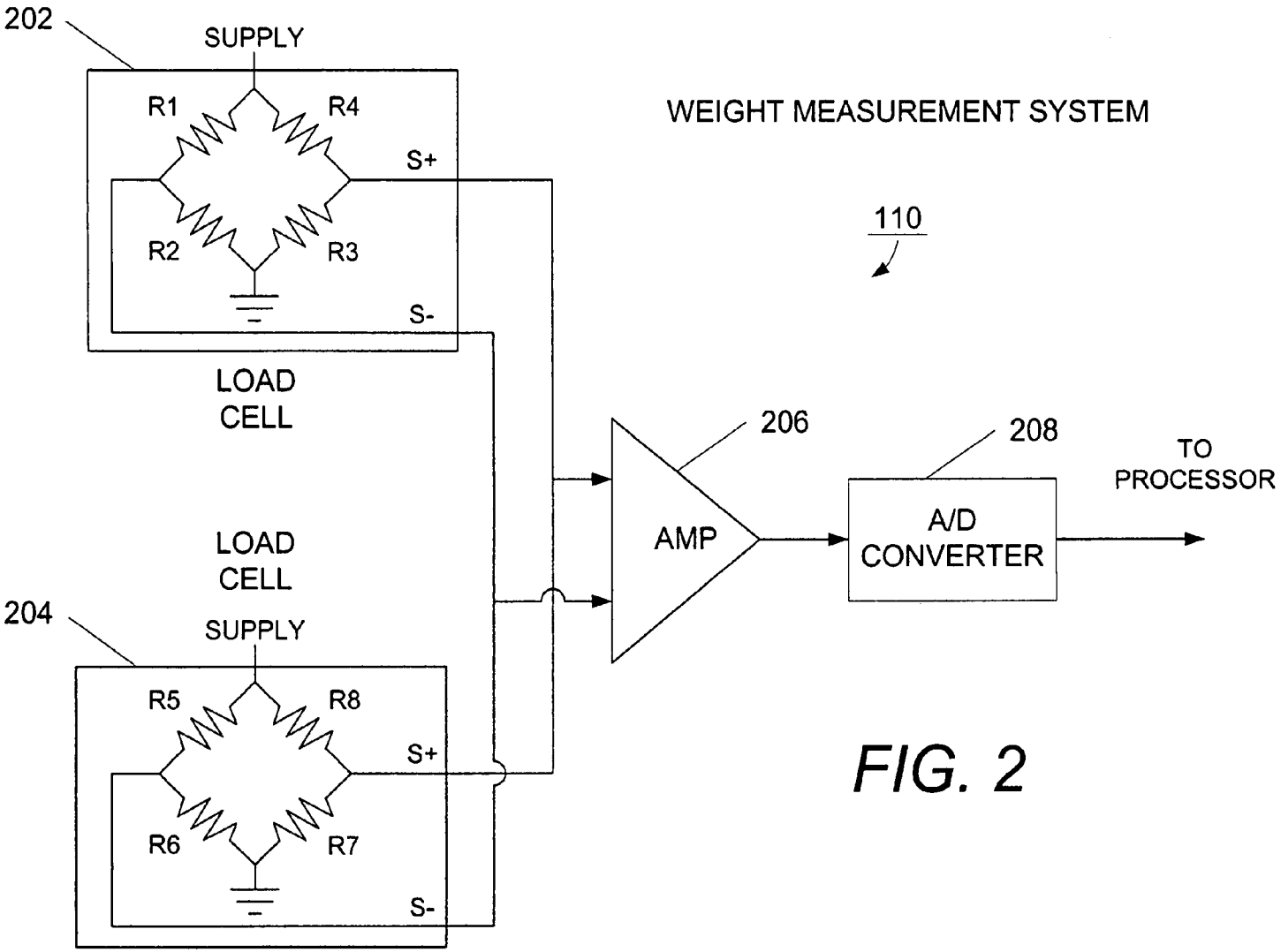
FIG. 2 illustrates a circuit and block diagram of the weight measurement system of FIG. 1, according to aspects of an embodiment of the invention.

FIG. 2 illustrates a block diagram of the weight measurement system 110 of FIG. 1, according to aspects of an embodiment of the invention. As shown in FIG. 2, the weight measurement system 110 includes a plurality of load cells 202 and 204, connected in parallel with respect to an amplifier 206, connected in turn to an analog-to-digital converter 208. According to one embodiment, the load cells 202 and 204 physically accept the weight of a user and output a signal representative of the weight. The signal is amplified and changed to a digital signal and forwarded to the microprocessor 104. The microprocessor 104 converts the signal to a value of the user's weight. According to one embodiment, the value is within a predetermined tolerance of the actual value of the user's weight. For example, the microprocessor 104 determines the value within±about 2 pounds.

In an embodiment, each of the load cells 202 and 204 comprise a device whose electrical properties, such as, for example, resistance, varies in proportion to the amount of strain in the device, such as, for example, a strain gauge. In one embodiment, the strain gauge responds to strain with a linear change in electrical resistance. When the resistances of the strain gauge are place in a Wheatstone bridge configuration, the bridge amplifies even small changes in the resistance due to changes in the strain on the gauge, such as added weight. In an embodiment, resistance values R1 and R4 decrease and R2 and R3 increase as the strain in the gauge increases (e.g., a load is applied), thereby increasing the output differential voltage. Moreover, the foregoing bridge configuration preferably includes a one kiloOhm (1 KΩ) bridge, a one milliAmp (1 mA) supply current, a one point five millivolt per Volt (1.5 mV/V) output signal and a five volt (5 V) power source, although a skilled artisan will recognize from the disclosure herein other values can be used for the bridge configuration.

As shown in FIG. 2, placement of the two full bridge circuits in parallel ensures that accurate readings occur even when weight is unequally distributed between the two load cells 202 and 204. Moreover, use of the full bridge configuration reduces the effects changes in temperature have on the strain gauges and allows for the removal of balancing resistors, while use of a flexible circuit for intra-bridge connection reduces contact resistance errors.

FIG. 2 also shows the output of the load cells 202 and 204 input into the amplifier 206, and the amplified output input into the analog-to-digital converter 208, where the analog output voltage is converted into a digital output values (e.g., A/D counts). According to one embodiment, the A/D converter 208 outputs counts ranging from 0 to 1024.

Although the weight measurement system 110 is disclosed with reference to its preferred embodiment, the invention is not intended to be limited thereby. Rather, a skilled artisan will recognize from the disclosure herein a wide number of alternatives for acquiring a microprocessor-usable signal that can be processed to determine an accurate value of the user's weight. For example, the microprocessor 104 may accept and process an analog signal to determine a user's weight. Moreover, other convenient weighing devices which do not interfere with the user of the exercise assembly 102 can be employed to provide a signal usable to determine the user's weight.

Figure 3A:
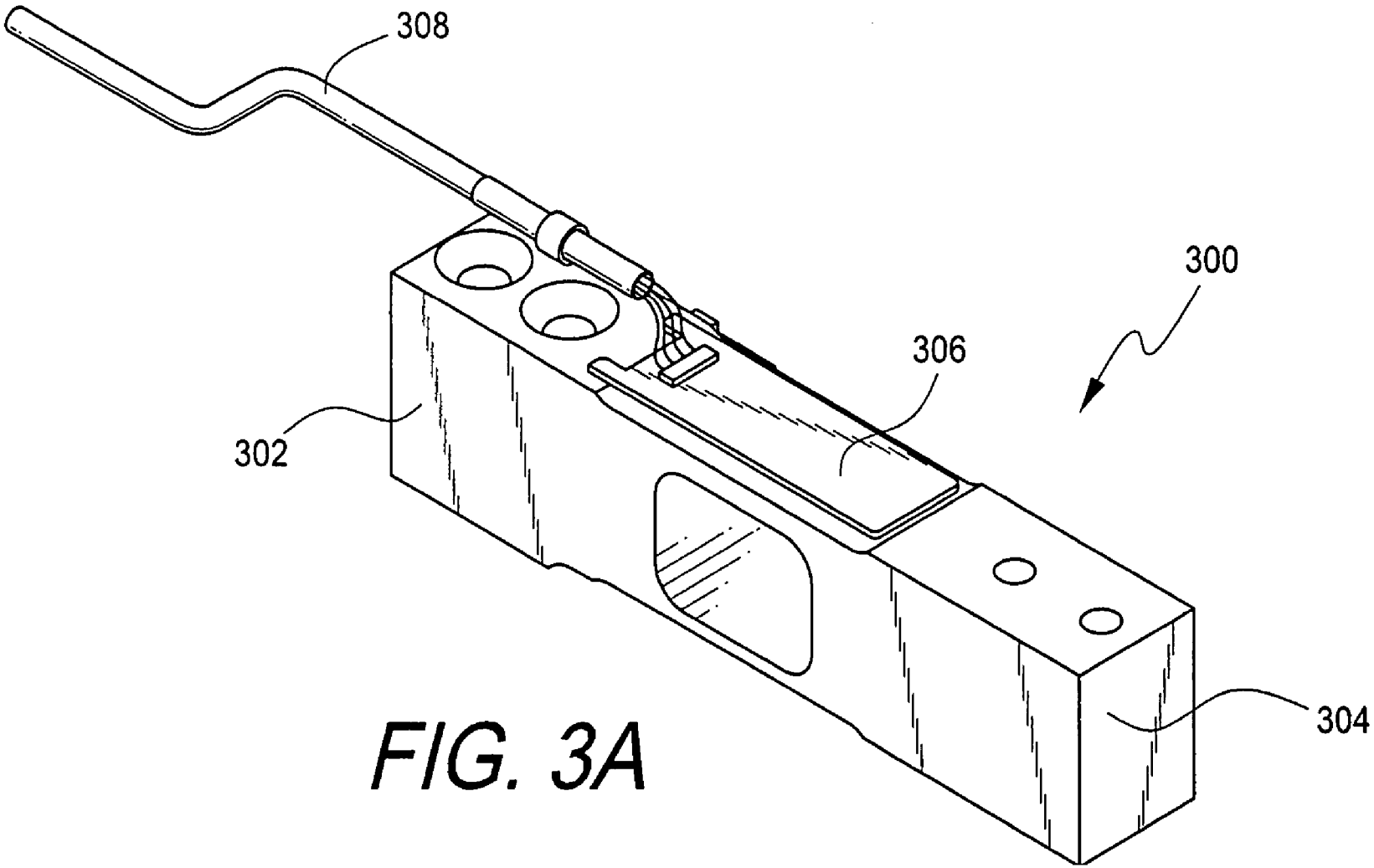
FIGS. 3A and 3B illustrate a perspective views of load cells of the weight measurement system of FIG. 2, according to aspects of an embodiment of the invention.

FIG. 3A illustrates a perspective view of a load cell 300 of the weight measurement system 110 of FIG. 2, according to aspects of an embodiment of the invention. The load cell 300 preferably comprises materials less prone to strain hardening or other structural property shifting due to time, such as, for example, aluminum. However, an artisan will recognize from the disclosure herein that steel, other materials, or combinations of materials or composites can also be used. According to one embodiment, the load cell 300 includes a frame mounting portion 302 positioned proximate a platform mounting portion 304 such that when the frame mounting portion 302 is attached to the exercise machine 100 and a load is applied by the user standing on the machine, strain occurs appropriately within, across, or through the load cell 300. Electronic components 306 change their resistance in proportion to the strain on the load cell 300, and corresponding voltages are communicated through electrical connection 308.

As shown in FIG. 3A, the load cell 300 comprises a beam sensor style load cell of square stock having a cutout portion extending through a plurality of sides. The cutout portion provides and to some degree controls the amount of deflection in the stock after a load is applied. As disclosed, the amount of deflection varies the sensitivity of the load cell 300. The load cell 300 can also include a mechanical stop to avoid overload deflection that can damage one or more of the electronic components 306. In an embodiment, the mechanical stop comprises an adjustable set screw which floats above a portion of the frame of the exercise assembly 102 until sufficient deflection causes the set screw to contact the frame, thereby stopping further deflection. An artisan will recognize from the disclosure herein that an adjustable mechanical stop could be part of the frame or other stops configured to limit the range of deflection of the load cell to avoid damage to, for example, the electronic components 306.

Figure 3B:
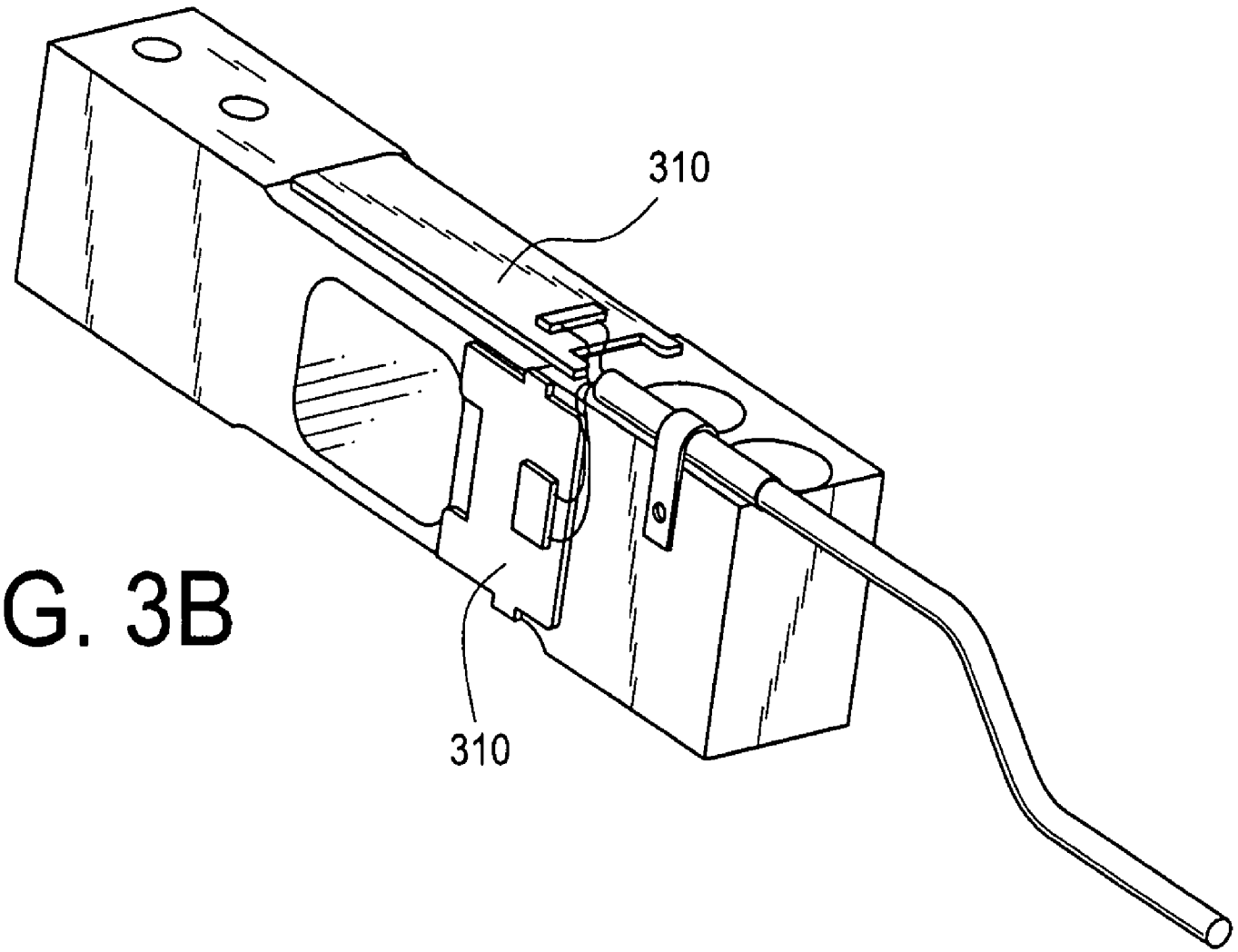

An artisan will also recognize from the disclosure herein that the load cell 300 can comprise a wide variety of different shapes, widths, thickness, or the like, having a correspondingly wide variety of different cutout shapes designed to vary the sensitivity, or available deflection, in the load cell 300. According to an embodiment, the load cell 300 preferably comprises dimensions of about six inches by one inch by one and one-half inches (6.0×1.0×1.5) having through holes 302 measuring about 2×0.328 and through holes 304 measuring about 2×5/16-18 UNC-2B threaded to a depth of 0.75 inches. Moreover, as shown in FIG. 3B, an embodiment of the load cell can include electronic components 310, which are configured in a split bridge arrangement where at least some of the strain gauge film is attached to different sides of the load cell.

Although the load cell 300 is disclosed with reference to its preferred embodiment, the invention is not intended to be limited thereby. Rather, a skilled artisan will recognize from the disclosure herein a wide number of alternative structures for the load cell 300 or the configuration of the load cell 300. For example, the load cell 300 may comprise a base palter style load cell, preferably having dimensions of about six and one-half inches by one inch by one-half inch (6.5×1×0.5).

Figure 4:
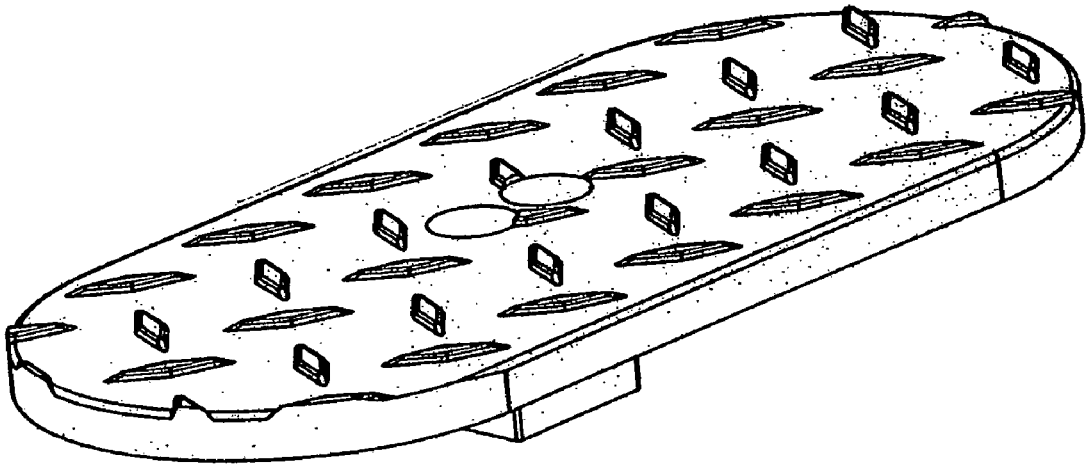
FIG. 4 illustrates a perspective view of a non-slip platform or footpad of a footpad detection embodiment of the weight measurement system of FIG. 2.

FIG. 4 shows a non-slip footpad or platform 400 sized to receive a foot of the user in a footpad detection embodiment of the weight measurement system 110. The platform 400 includes raised edges, tread or ridges 402, shown as exemplary offset diamonds, designed to create sufficient friction to avoid slippage by the user. In the footpad detection embodiment of the weight measurement system 110, the platform 400 mechanically attaches to the load cell 300, through for example a pair of bolts, to apply stress thereto when a user stands on the platform 400. Although the platform 400 is disclosed with reference to its preferred embodiment, the invention is not intended to be limited thereby. Rather, a skilled artisan will recognize from the disclosure herein a wide number of alternative structures for supporting the user in a safe manner during weighing.

Figure 5:
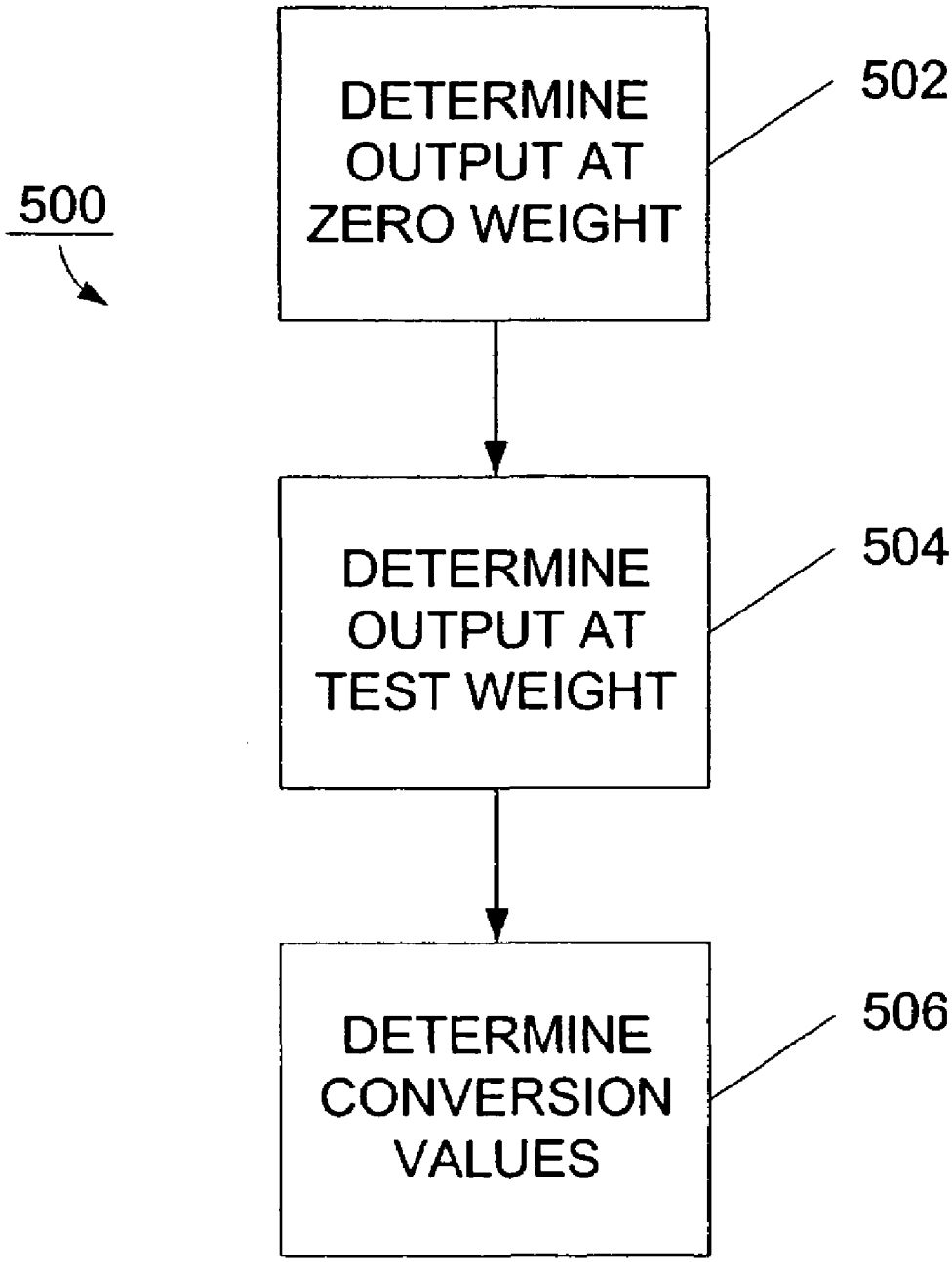
FIG. 5 illustrates a flow chart of a calibration process for calibrating the load cells of FIG. 2.

FIG. 5 illustrates a flow chart of a calibration process 500 for calibrating the load cells 202 and 204 of FIGS. 2 and 3A. As shown in FIG. 5, the process 500 includes block 502 where the microprocessor 104 determines the output of the A/D converter 208, such as the A/D count, when no weight is applied to the load cells 202 and 204. According to an embodiment, the foregoing zero weight calibration output from the A/D converter 208 preferably allows for a range of output A/D counts that correspond to and can accurately reflect a preferred weight measurement range. In one embodiment, the weight measurement system 110 can accurately determine the weight of users less than approximately 500 pounds. More preferably, the weight measurement system 110 can accurately determine the weight of users between about 50 pounds and about 350 pounds with the mechanical overload for each cell being approximately 385 pounds.

According to an embodiment, the zero weight calibration output from the A/D converter 208 preferably is less than about 500 A/D counts of the available 1024 A/D counts. More preferably, the zero weight calibration output from the A/D converter 208 ranges from about 100 to about 200 A/D counts. Even more preferably, the zero weight calibration output from the A/D converter 208 is about 120 A/D counts. The higher the zero weight A/D counts, the more probability for erratic readings due to lower resolution. Moreover, zero weight A/D counts higher than about 270 A/D units may indicate significant stress already on the load cell 300 indicating improper stressed mounting, binding, or other potential partial or complete failures.

The calibration process 500 proceeds to block 504, where the microprocessor 104 determines the output of the A/D converter 208, such as the A/D count, when a test weight is applied to the load cells 202 and 204. According to an embodiment, the test weight comprises increments of about 100 pounds. The corresponding test weight calibration output from the A/D converter 208 preferably is the zero weight calibration output plus (+) at least one (1) A/D count per pound weight of the test weight. According to one embodiment, the test weight calibration output corresponding to a 100 pound test weight is about 300 A/D units, whereas the test weight calibration output corresponding to a 200 pound test weight is about 420 A/D units.

The calibration process 500 proceeds to block 506, where the microprocessor 104 determines conversion values that can be used to calculate an accurate value of the user's weight from a given output from the A/D converter 208. According to one embodiment, the output changes linearly, therefore, the conversion values comprise a ratio. According to other embodiments, the conversion values may comprise a table, a formula or function, combinations of the same, or the like. In an embodiment, the microprocessor 104 uses the conversion values to calculate a user's weight in under 6 seconds.

After the microprocessor 104 executes the calibration process 500, the exercise machine 100 can accurately calculate the value of a user's weight. The calibration process 500 may be periodically run to ensure accurate and current conversion values are being used. For example, straightforward recalibration can ensure error free replacement, maintenance and the like of the load cells.

Figure 6A:
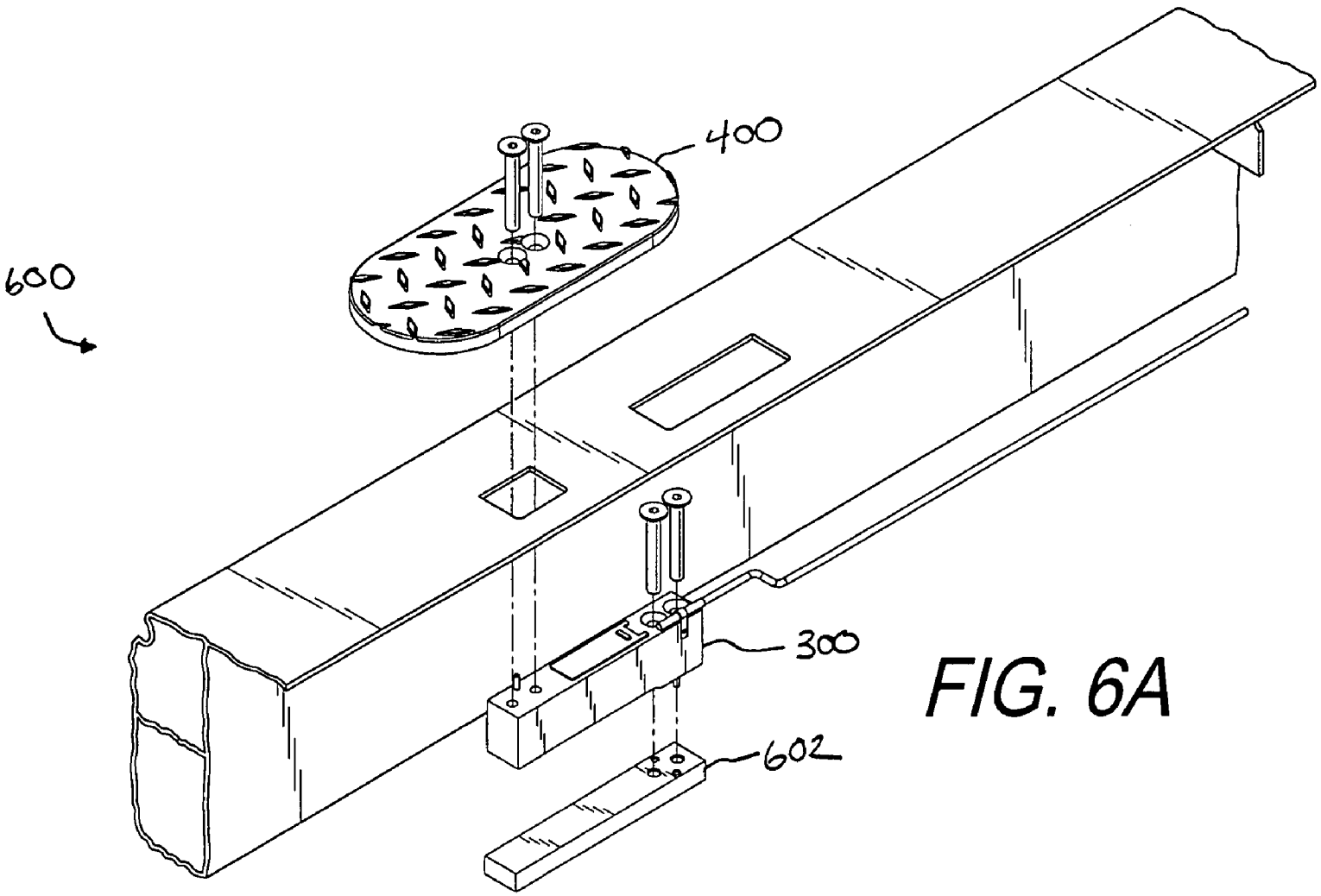
FIGS. 6A and 6B illustrate perspective views of a treadmill including the footpad detection embodiment of the weight measurement system of FIG. 4.
Figure 6B:
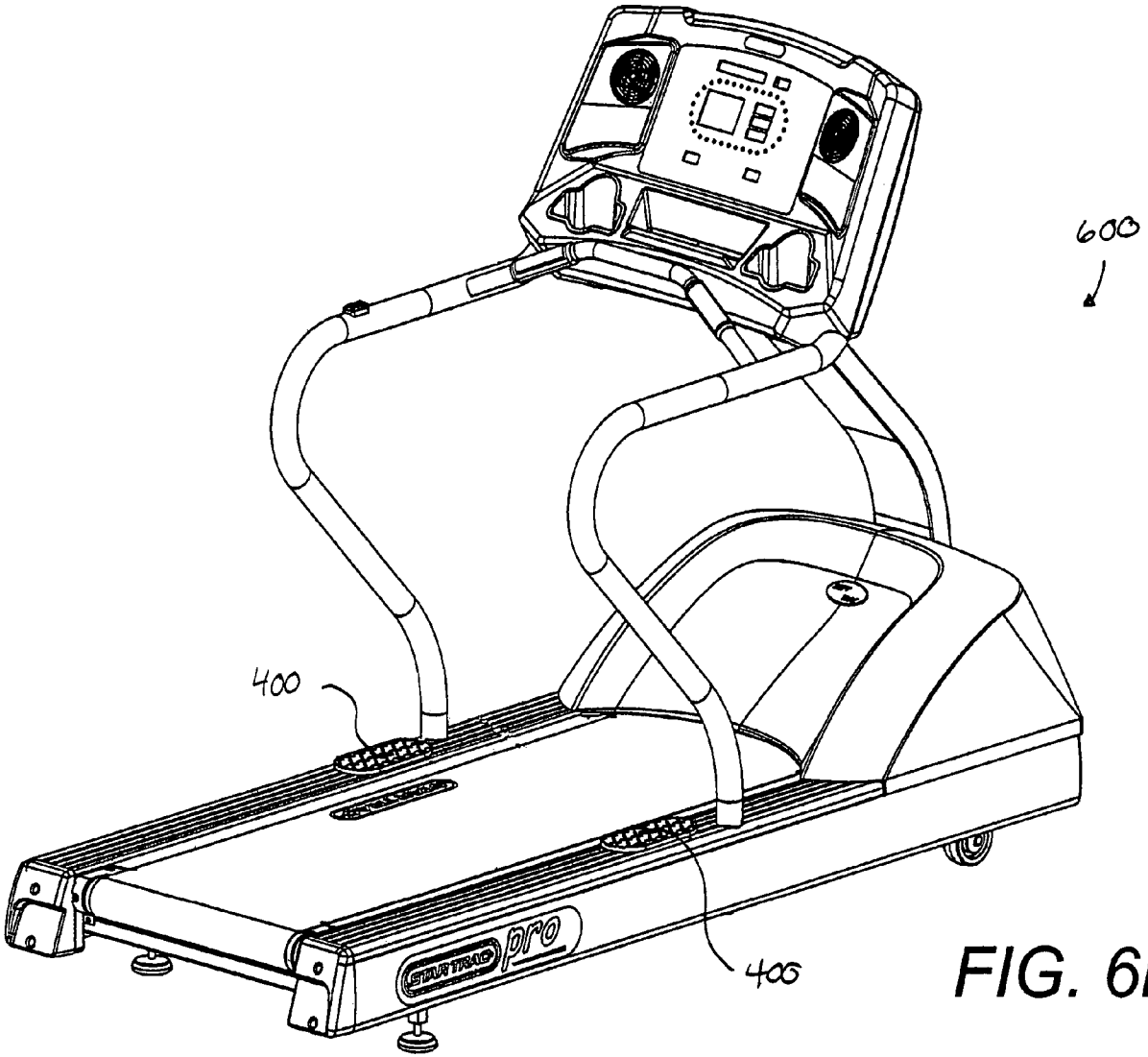

FIGS. 6A and 6B illustrate a treadmill 600, which includes the footpad detection embodiment of the weight measurement system 110 of FIG. 4. Specifically, FIG. 6A illustrates a simplified exploded view of the footpad detection embodiment, while FIG. 6B illustrates an exemplary treadmill 600. As shown in FIG. 6A, the footpad detection embodiment includes the load cell 300 attached to a mounting platform 602. The mounting platform 602 can advantageously include threaded bores and one or more holes which receive one or more attachment mechanisms in a manner that provides proper spacing between the load cell 300 and the mounting platform 602, and substantially prevents lateral movement between the same. According to an embodiment, the load cell 300 includes one or more pins protruding downwardly which mate with the one or more holes of the mounting platform 602 to provide sufficient anchor points to substantially avoid side to side displacement of the load cell 300. The load cell 300 can also employ one or more mounting pins to sufficiently anchor the footpad 400 to the load cell 300 to substantially avoid side to side displacement of the same. However, from the disclosure herein, a skilled artisan will recognize other mechanisms for substantially securing the load cell 300 to the frame of the treadmill 600.

FIG. 6B shows the treadmill 600 comprising the one or more footpads or platforms 400 installed in proximity to side rails of the frame, such as the sides of the an endless belt, and mechanically connected to the footpad detection embodiment as disclosed in the foregoing.

Figure 7:
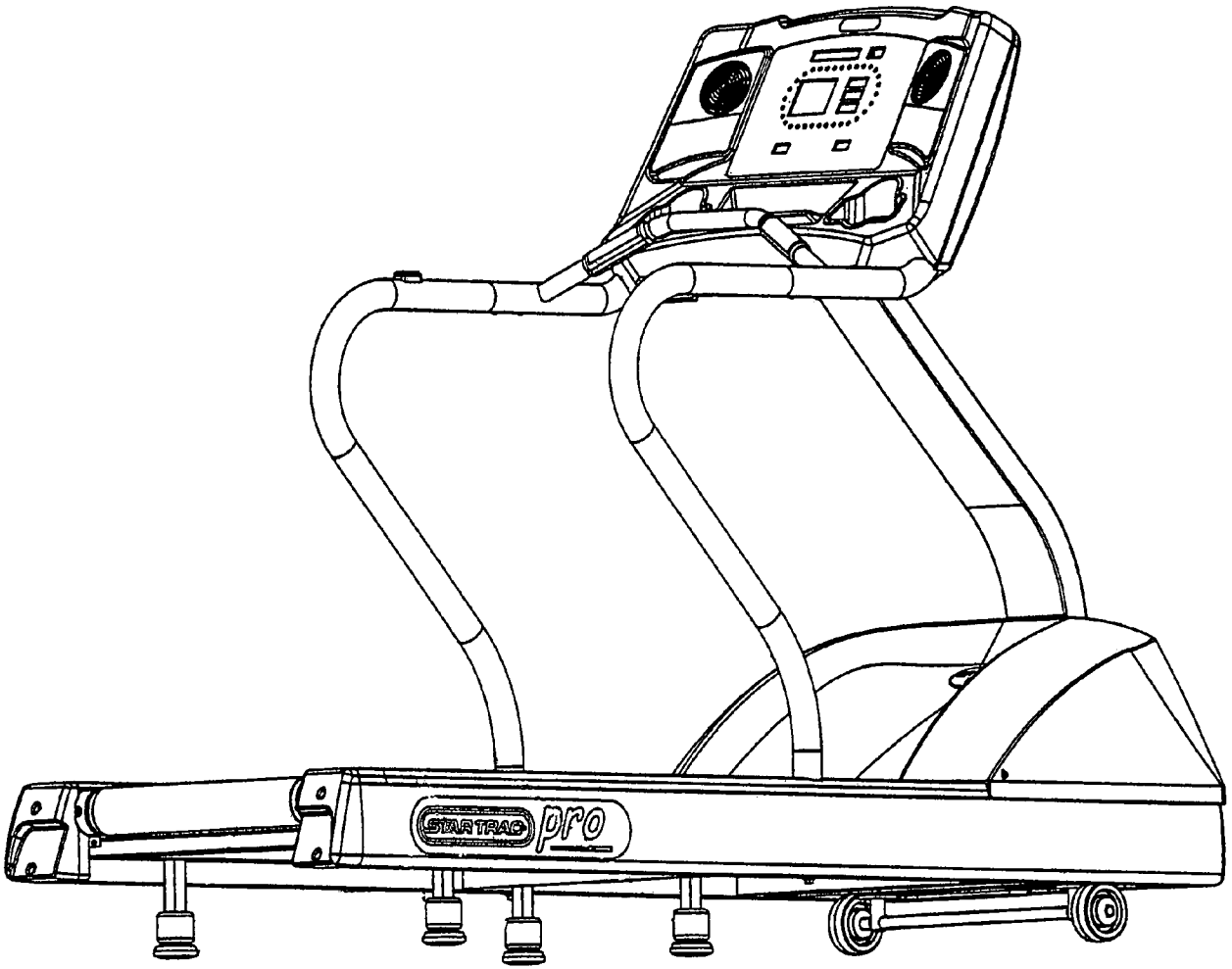
FIG. 7 illustrates a treadmill including a deck detection embodiment of the weight measurement system of FIG. 2.

Although the foregoing invention has been described in terms of certain preferred embodiments, other embodiments will be apparent to those of ordinary skill in the art from the disclosure herein. For example, FIG. 7 illustrates a treadmill, which includes the deck detection embodiment of the weight measurement system 110 of FIG. 2. The load cells of the treadmill of FIG. 7 support at least a portion of the weight of the treadmill on a plurality of support pads. The load cells, preferably pog-shaped structures mounted in or mechanically to the support pads, sense the weight of an empty treadmill as the zero weight value during, for example, calibration. Then, as a user steps onto the treadmill of FIG. 7, the load cells detect the change.

In the embodiment of FIG. 7, the support pads are spaced throughout the base of the treadmill, such as, for example, two on a center axis support bar and two on the frame rails. A user can be instructed to stand in a particular location, such as on foot indicia along the frame rails or endless belt, which are located to approximately center the user's weight over the spaced apart support pads and load cells. In one embodiment, the plurality of load cells comprise a plurality of Wheatstone bridge configurations connected electrically in parallel, thereby allowing for accurate weight determinations even during unbalanced loading.

Additionally, other combinations, omissions, substitutions and modifications will be apparent to the skilled artisan in view of the disclosure herein, such as, for example, half bridge configurations tying two load cells together, RS232 capability on the output of the load cells, or the like. Accordingly, the present invention is not intended to be limited by the reaction of the preferred embodiments, but is to be defined by reference to the appended claims. Moreover, all publications, patents, and patent applications mentioned in this specification are herein incorporated by reference to the same extent as if each individual publication, patent, or patent application was specifically and individually indicated to be incorporated by reference.

What is claimed is:

1. A treadmill comprising:

a frame at least substantially housing a motor assembly operable to drive a belt disposed around rollers, wherein operation of the motor assembly causes the belt to move which facilitates exercise of a user and wherein said frame includes at least two frame arms, each of said two frame arms positioned substantially parallel to said belt when said belt is in use at at least a substantially non-inclined position;

an electronic display capable of displaying exercise-related information; and a weight measurement system including a plurality of footpads, a plurality of load cells, and an electronic circuit, wherein each footpad is mechanically linked to a load cell within the respective frame arm to cause each footpad to float with respect to the frame arm, wherein each load cell converts deformation caused by the user standing on said mechanically linked footpad into an electrical signal indicative of a weight applied on a foot of said user, and wherein said electronic circuit combines said electrical signals from each load cell into an output signal, said electronic display being responsive to said output signal to determine a numerical value indicative of the user's weight, wherein at least some of the exercise-related information displayed on the electronic display is calculated using said numerical value.

2. The treadmill of claim 1, wherein one of the exercise-related information comprises speed or limitations on speed.

3. The treadmill of claim 1, wherein one of the exercise-related information comprises resistance or limitations on resistance.

4. The treadmill of claim 1, wherein one of the exercise-related information comprises one of caloric burn rate, current calories burned and total calories burned.

5. The treadmill of claim 1, wherein one of the exercise-related information comprises a body mass index.

6. The treadmill of claim 1, wherein one of the exercise-related information comprises a fitness value.

7. The treadmill of claim 1, wherein one of the exercise-related information comprises a percent body fat.

8. The treadmill of claim 1, wherein the electronic circuit comprises a Wheatstone bridge circuit.

9. The treadmill of claim 1, wherein said numerical value is determined when the user's weight is unevenly distributed across the plurality of load cells.

10. The treadmill of claim 1, wherein the load cells comprise aluminum.

11. The treadmill of claim 1, wherein the electronic display displays a measurement of the user's weight determined from said numerical value.

12. The treadmill of claim 1, wherein one of the exercise related information comprises one or more of caloric burn rate, current calories burned, total calories burned, speed or limitations on speed, or resistance or limitations on resistance.

13. A method of determining an exercise parameter using an indication of an exerciser's weight, the method comprising:

acquiring a signal from a weight measurement system of a treadmill comprising a frame including frame arms, said weight measurement system including a plurality of footpads, a plurality of load cells, and an electronic circuit, wherein each footpad is mechanically linked to a load cell within the respective frame arm to cause each footpad to float with respect to the frame arm, wherein each load cell converts deformation caused by an exerciser standing on said mechanically linked footpad into an electrical signal indicative of a weight applied on a foot of said exerciser, and wherein said electronic circuit combines said electrical signals from each load cell into an output signal indicative of the exerciser's weight after the exerciser has boarded the treadmill, said treadmill also comprising a motor operated belt, and an electronic display;

calculating a representation of the exerciser's weight using at least the output signal; and calculating a parameter using at least said representation.

14. The method of claim 13, comprising calculating a physiological parameter using said representation.

15. The method of claim 14, wherein one of said physiological parameters include a body mass index or range, a fitness value or range, or a percent body fat.

16. The method of claim 13, comprising calculating an exercise-related information using said representation.

* * * * *